US010670986B2

(12) United States Patent
Gofuku et al.

(10) Patent No.: US 10,670,986 B2
(45) Date of Patent: Jun. 2, 2020

(54) DEVELOPING APPARATUS AND IMAGE FORMING APPARATUS

(71) Applicant: CANON KABUSHIKI KAISHA, Tokyo (JP)

(72) Inventors: Shuichi Gofuku, Numazu (JP); Hideki Maeshima, Mishima (JP); Soichi Ishii, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/139,528

(22) Filed: Sep. 24, 2018

(65) Prior Publication Data

US 2019/0101846 A1 Apr. 4, 2019

(30) Foreign Application Priority Data

Sep. 29, 2017 (JP) ..... 2017-190415

(51) Int. Cl.

*G03G 15/08* (2006.01)
*G03G 21/16* (2006.01)
*G03G 21/18* (2006.01)

(52) U.S. Cl.

CPC ..... *G03G 15/0808* (2013.01); *G03G 15/0865* (2013.01); *G03G 15/0896* (2013.01);
(Continued)

(58) Field of Classification Search

CPC ..... G03G 15/0808
(Continued)

(56) References Cited

U.S. PATENT DOCUMENTS 6,839,529 B2 1/2005 Yasui et al.
7,352,981 B2 4/2008 Fuwazaki et al.
(Continued)

FOREIGN PATENT DOCUMENTS

EP 3 223 082 A2 9/2017
JP 2005-345696 A 12/2005
(Continued)

OTHER PUBLICATIONS

European Search Report dated Dec. 19, 2018, in related European Patent Application No. 18196533.6.
(Continued)

*Primary Examiner* — Quana Grainger
(74) *Attorney, Agent, or Firm* — Venable LLP

(57) ABSTRACT

At ends of a frame in an axial direction of a developing roller, a first end portion member and a second end portion member are provided so as to be rotatable around a rotation axis parallel to the axial direction, and at least one of them has one side in a direction orthogonal to the rotation axis on which a force receiving portion is provided, and another side in the direction orthogonal to the rotation axis on which a regulating portion is provided. The force receiving portion receives a biasing force in a mounting direction of the developing apparatus to the apparatus main body from a biasing member. The regulating portion is brought into contact with the apparatus main body to regulate movement of the other side relative to the apparatus main body in a direction opposite to the mounting direction, with a fulcrum being the rotation axis.

9 Claims, 16 Drawing Sheets

(52) U.S. Cl.
CPC ..... *G03G 21/1676* (2013.01); *G03G 21/185* (2013.01); *G03G 2221/1654* (2013.01)

(58) Field of Classification Search
USPC ..... 399/279
See application file for complete search history.

(56) References Cited

U.S. PATENT DOCUMENTS

| | | | |
|---|---|---|---|
| 7,499,662 | B2 | 3/2009 | Fuwazaki et al. |
| 7,933,534 | B2 | 4/2011 | Hoshi et al. |
| 8,666,281 | B2 | 3/2014 | Ueda et al. |
| 8,682,211 | B2 | 3/2014 | Hoshi et al. |
| 8,831,487 | B2 | 9/2014 | Kashiide et al. |
| 9,026,002 | B2 | 5/2015 | Sato et al. |
| 9,213,267 | B2 | 12/2015 | Hoshi et al. |
| 9,285,756 | B2 | 3/2016 | Kashiide et al. |
| 9,335,725 | B2 | 5/2016 | Sato et al. |
| 2009/0290904 | A1 | 11/2009 | Kawai et al. |
| 2013/0322920 | A1* | 12/2013 | Maeshima ..... G03G 15/0808 399/111 |
| 2017/0248905 | A1 | 8/2017 | Anan et al. |

FOREIGN PATENT DOCUMENTS

| | | | |
|---|---|---|---|
| JP | 2006-039432 | A | 2/2006 |
| JP | 2013-182036 | A | 9/2013 |
| RU | 2453887 | C1 | 6/2012 |
| RU | 2529774 | C2 | 9/2014 |

OTHER PUBLICATIONS

Singaporean Search Report and Written Opinion dated May 16, 2019, in related Singaporean Patent Application No. 10201808506X.
Russian Notice of Allowance and Search Report dated Sep. 5, 2019, in related Russian Patent Application No. 2018133605 (with English translation).

* cited by examiner

DEVELOPING APPARATUS AND IMAGE FORMING APPARATUS

BACKGROUND OF THE INVENTION

Field of the Invention

The present invention relates to an electrophotographic image forming apparatus using a developing apparatus.

Description of the Related Art

With regard to image forming apparatus such as printers, which use the electrophotographic image forming method (electrophotographic process), for the purpose of achieving easy maintenance of process means, an image forming apparatus in which various kinds of process means are configured as a process cartridge that is removably mounted to the main body of the image forming apparatus has been put to practical use. The process cartridge may be dividable into some process cartridges such as a cleaning cartridge including a photosensitive drum (electrophotographic photosensitive member), a developing cartridge including developing means, and a toner cartridge configured to supply developer.

Japanese Patent Application Laid-open No. 2013-182036 discloses an image forming apparatus in which the frame of a developing cartridge includes a first frame by which a developing roller is rotatably supported, and a second frame by which both the end portions of the first frame in the longitudinal direction of the developing roller are rotatably supported. When the developing cartridge is mounted to the main body of the image forming apparatus, the second frame is positioned with respect to the apparatus main body. The developing roller can be brought into contact with or separated from a photosensitive drum through pivotal movement of the first frame relative to the second frame.

SUMMARY OF THE INVENTION

In the configuration disclosed in Japanese Patent Application Laid-open No. 2013-182036, the second frame has a portion configured to support one end portion of the first frame, a portion configured to support the other end portion thereof, and a portion configured to connect such portions to each other. The second frame extends from one end portion to the other end portion of the first frame and crosses the developing roller in the longitudinal direction. It is accordingly necessary to take a space for provision of the second frame into consideration in designing the dimensions of the developing cartridge, which is a developing apparatus. It is concerned that the space may become a factor that prevents a reduction in size of the apparatus.

An object of the present invention is to provide a technology that achieves a reduction in size of a developing apparatus.

In order to achieve the above-mentioned object, a developing apparatus of the present invention includes:

a frame configured to rotatably support a developing roller;

a first end portion member provided at one end of the frame in an axial direction of the developing roller so as to be rotatable relative to the frame around a rotation axis parallel to the axial direction; and a second end portion member provided at another end of the frame in the axial direction so as to be rotatable relative to the frame around the rotation axis, wherein the developing apparatus is removably mounted to an apparatus main body of an image forming apparatus in the axial direction, wherein at least one end portion member of the first end portion member and the second end portion member has a force receiving portion and a regulating portion, wherein the force receiving portion is provided on one side of said one end portion member in a first direction orthogonal to the rotation axis, and receives biasing force from a biasing member of the apparatus main body in a mounting direction when the developing apparatus is mounted to the apparatus main body, and wherein the regulating portion is provided on the other side of said one end portion member in the first direction, and is brought into contact with the apparatus main body to regulate movement of the other side of said one end portion member relative to the apparatus main body in a direction opposite to the mounting direction, with a fulcrum being the rotation axis.

In order to achieve the above-mentioned object, an image forming apparatus of the present invention includes:

the developing apparatus of the present invention; and an apparatus main body to which the developing apparatus is removably mounted.

According to the present invention, the developing apparatus can be reduced in size.

Further features of the present invention will become apparent from the following description of exemplary embodiments with reference to the attached drawings.

DESCRIPTION OF THE EMBODIMENTS

Hereinafter, a description will be given, with reference to the drawings, of embodiments (examples) of the present invention. However, the sizes, materials, shapes, their relative arrangements, or the like of constituents described in the embodiments may be appropriately changed according to the configurations, various conditions, or the like of apparatuses to which the invention is applied. Therefore, the sizes, materials, shapes, their relative arrangements, or the like of the constituents described in the embodiments do not intend to limit the scope of the invention to the following embodiments.

Embodiment

Here, an electrophotographic image forming apparatus (hereinafter referred to as "image forming apparatus") is an apparatus configured to form an image on a recording material (recording medium) using the electrophotographic image forming process. Examples of the image forming apparatus include printers (laser beam printer, LED printer, and the like), a copying machine, a facsimile apparatus, a word processor, and a multifunction peripheral thereof (multifunction printer). Examples of the recording material include a recording sheet and a plastic sheet.

Further, a developing apparatus is an apparatus configured to develop, with developer, an electrostatic latent image formed on a drum-shaped electrophotographic photosensitive member (hereinafter referred to as "photosensitive drum"). The developing apparatus includes developing means, a developing unit configured to support the developing means, parts related to the developing means, and the like. Examples of the developing means include a developing roller, an applying roller, and a developing blade. The developing apparatus of the present embodiment is configured as a developing cartridge that is removably mounted to the apparatus main body of the image forming apparatus.

Further, a process cartridge includes the photosensitive drum and process means for acting on the photosensitive drum, which are entirely or partly integrated as a cartridge, and is removably mounted to the main body of the image forming apparatus. Examples of the process means include charging means for acting on the photosensitive drum, the developing means, and cleaning means.

Whole Configuration of Image Forming Apparatus

Figure 4:
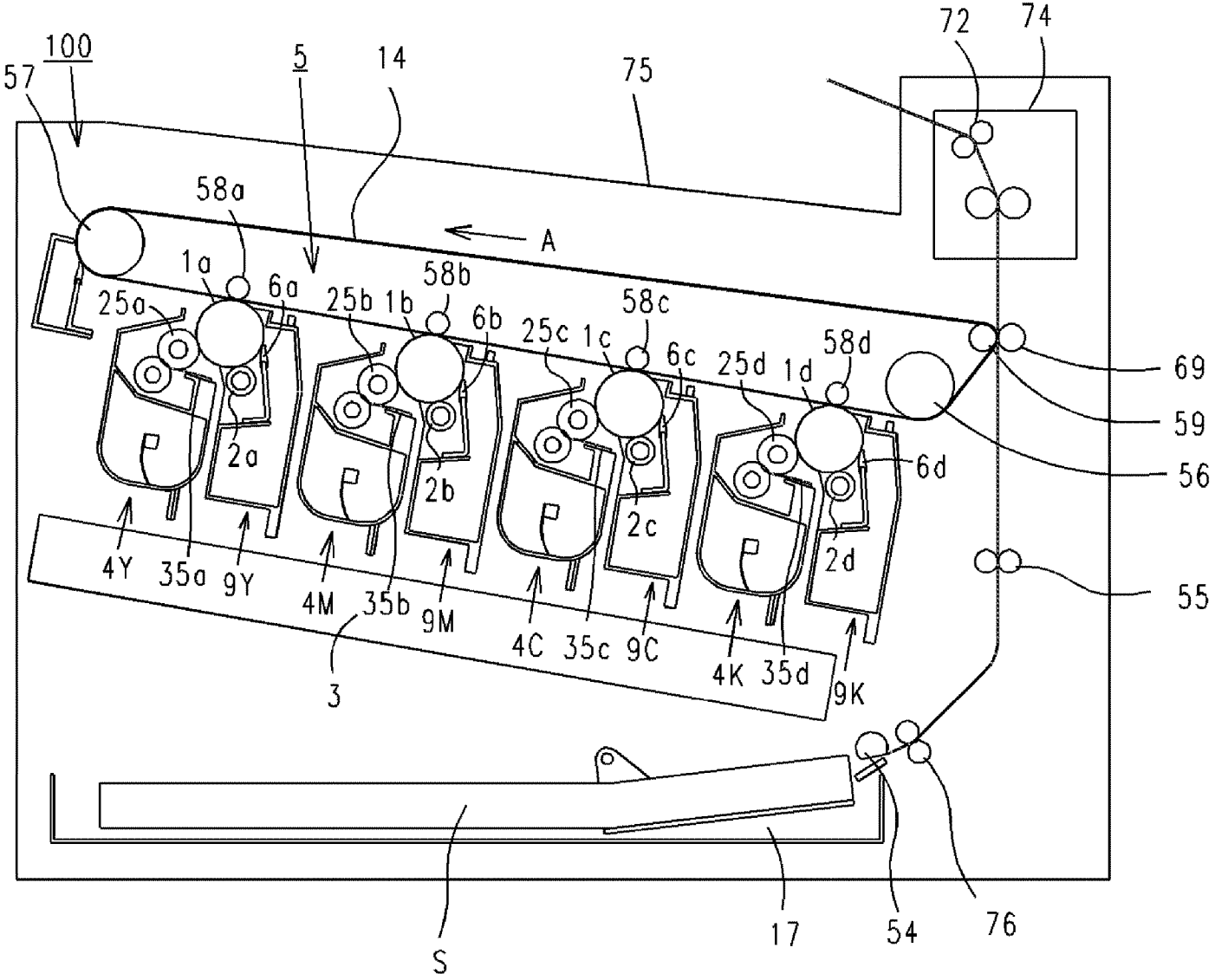
FIG. 4 is a schematic sectional view of an image forming apparatus according to the present embodiment.

With reference to FIG. 4, the whole configuration of an image forming apparatus 100 according to the embodiment of the present invention is described. As illustrated in FIG. 4, four drum cartridges 9 (9Y, 9M, 9C, and 9K) and four developing apparatus (hereinafter referred to as "developing cartridges") 4 (4Y, 4M, 4C, and 4K) are removably mounted and supported inside the apparatus main body of the image forming apparatus 100 by mounting members (not shown). The upstream side and the downstream side in a mounting direction in which the drum cartridges 9 and the developing cartridges 4 are mounted to the image forming apparatus 100 are defined as a front-side-surface side and a back-side-surface side, respectively. As illustrated in FIG. 4, the drum cartridge 9 and the developing cartridge 4 are provided to be adjacent to each other in a direction inclined from a horizontal surface (horizontal direction) on which the image forming apparatus 100 is installed.

The drum cartridges 9 are obtained through integration of photosensitive drums 1 (1*a*, 1*b*, 1*c*, and 1*d*) and process means such as charging rollers 2 (2*a*, 2*b*, 2*c*, and 2*d*) and cleaning members 6 (6*a*, 6*b*, 6*c*, and 6*d*), which are arranged in the vicinity of the photosensitive drums 1. Further, the developing cartridges (4Y, 4M, 4C, and 4K) are obtained through integration of process means such as developing rollers 25 (25*a*, 25*b*, 25*c*, and 25*d*) and developing blades 35 (35*a*, 35*b*, 35*c*, and 35*d*).

The charging roller 2 uniformly charges the surface of the photosensitive drum 1, and the developing roller 25 develops, with developer (hereinafter referred to as "toner"), a latent image formed on the photosensitive drum 1 to form a visible image. The cleaning member 6 removes toner remaining on the photosensitive drum 1 after the toner image formed on the photosensitive drum 1 is transferred onto a recording material S. Further, a scanner unit 3 is provided below the drum cartridges 9 and the developing cartridges 4 inside the apparatus main body. The scanner unit 3 selectively exposes the photosensitive drums 1 on the basis of image information to form latent images on the photosensitive drums 1.

In the lower portion of the image forming apparatus 100, a cassette 17 in which the recording materials S are stored is mounted. In addition, recording medium transport means is provided so that the recording material S is conveyed to the upper part of the image forming apparatus 100 through a secondary transfer roller 69 and a fixing portion 74. Specifically, there are provided a feed roller 54 configured to separately feed the recording materials S in the cassette 17 one by one, a conveyance roller pair 76 configured to convey the fed recording material S, and a registration roller pair 55 configured to synchronize a latent image formed on the photosensitive drum 1 and the recording material S.

An intermediate transfer unit 5 is provided above the drum cartridges 9 and the developing cartridges 4 inside the apparatus main body. The intermediate transfer unit 5 is intermediate transfer means for transferring toner images formed on the respective photosensitive drums 1 (1*a*, 1*b*, 1*c*, and 1*d*). The intermediate transfer unit 5 includes a driver roller 56, a driven roller 57, primary transfer rollers 58 (58*a*, 58*b*, 58*c*, and 58*d*) arranged at positions opposed to the photosensitive drums 1 of the respective colors, and a counter roller 59 arranged at a position opposed to the secondary transfer roller 69. A transfer belt 14 is looped around the intermediate transfer unit 5. The transfer belt 14 faces all the photosensitive drums 1 and circulates (rotates in the direction A) while being in contact with the photosensitive drums 1. A toner image is primarily transferred from the photosensitive drum 1 onto the transfer belt 14 through voltage application to the primary transfer rollers 58 (58*a*, 58*b*, 58*c*, and 58*d*). Then, the toner image on the transfer belt 14 is transferred onto the recording material S through voltage application to the counter roller 59, which is arranged on the inner side of the transfer belt 14, and the secondary transfer roller 69.

When an image is formed, each photosensitive drum 1 rotates, and the scanner unit 3 selectively exposes the photosensitive drums 1 uniformly charged by the charging rollers 2. With this, electrostatic latent images are formed on the photosensitive drums 1. The latent images are developed by the developing roller 25. In this way, toner images of the respective colors are formed on the respective photosensitive drums 1. In synchronization with this image formation, the registration roller pair 55 conveys the recording material S to a secondary transfer position where the counter roller 59 and the secondary transfer roller 69 are in contact with each other through the transfer belt 14. Then, the toner images of the respective colors on the transfer belt 14 are secondarily transferred onto the recording material S through application of transfer bias voltage to the secondary transfer roller 69. As a result, a color image is formed on the recording material S. The recording material S having the color image formed thereon are heated and pressurized by the fixing portion 74 so that the toner image is fixed. Thereafter, the recording material S is discharged to a discharging portion 75 by a discharging roller 72. The fixing portion 74 is arranged in the upper portion of the image forming apparatus 100.

Drum Cartridge

Figure 5:
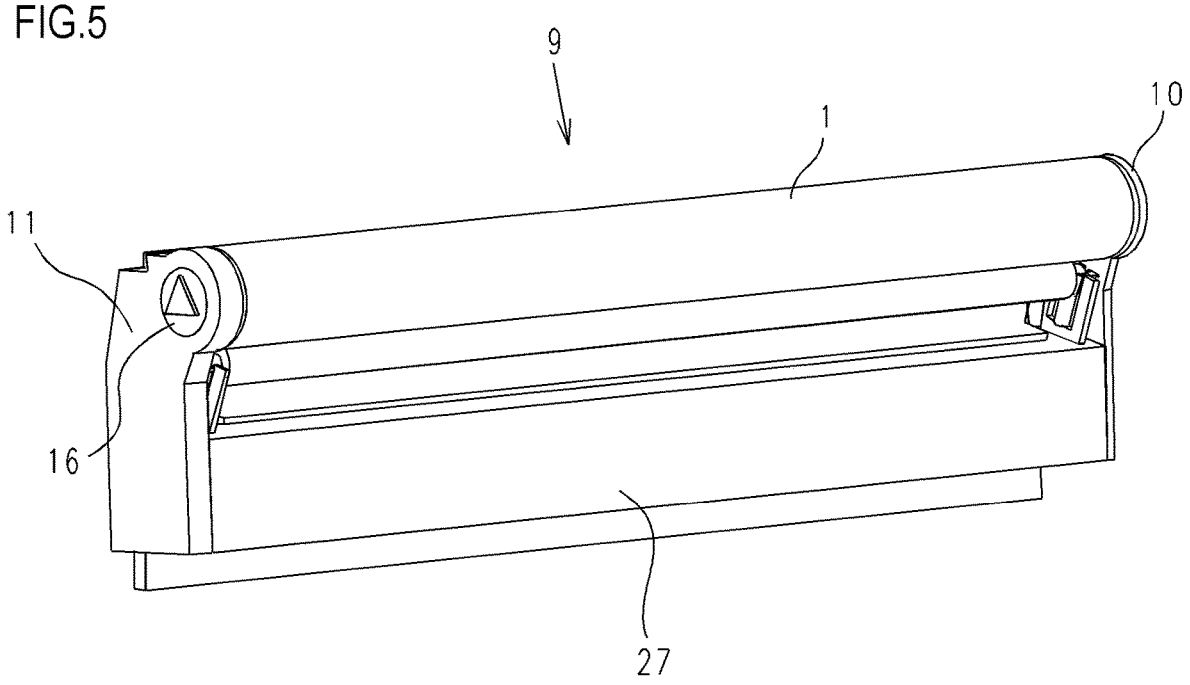
FIG. 5 is an explanatory view of a drum cartridge according to the present embodiment.
Figure 6:
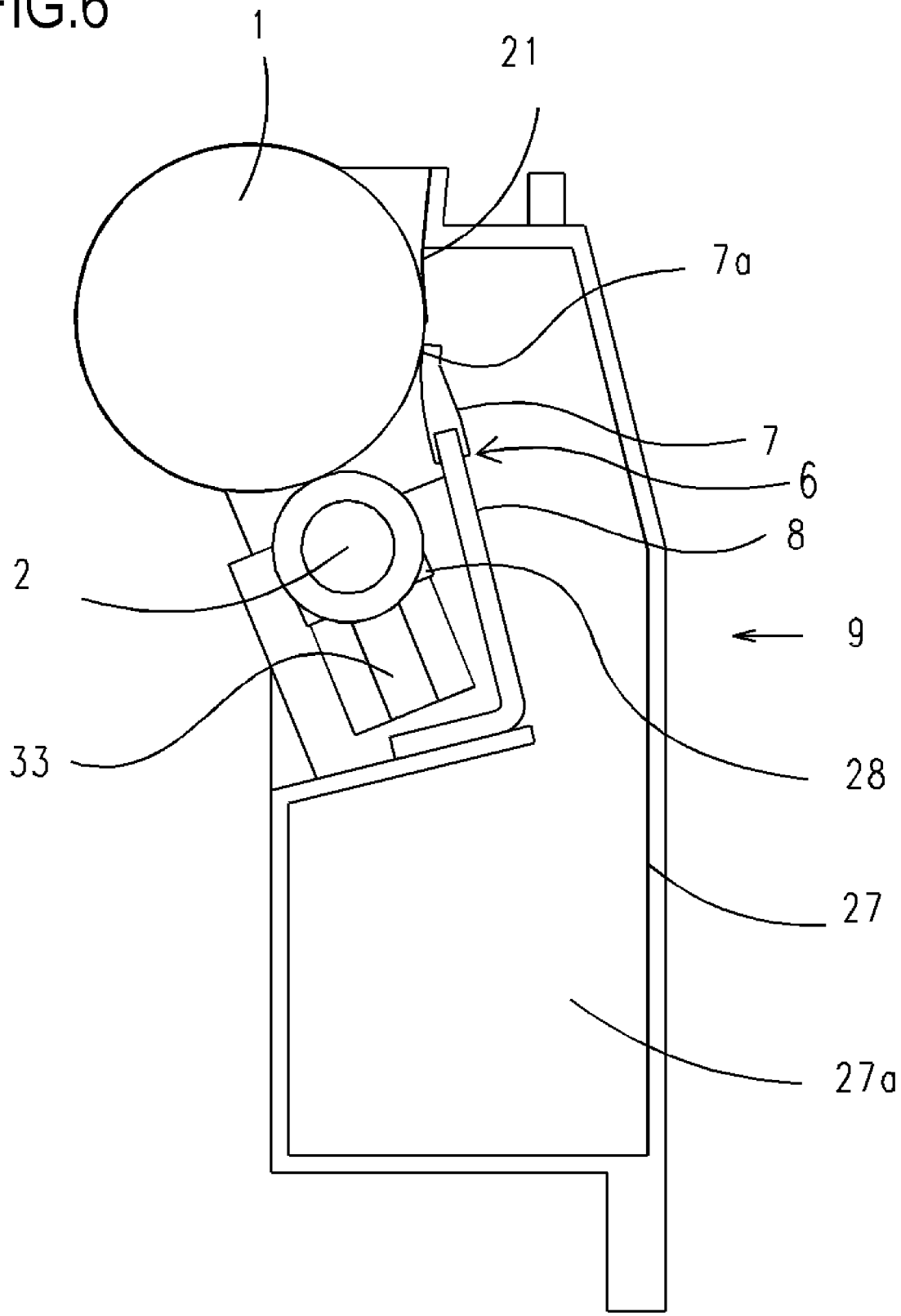
FIG. 6 is a main sectional view of the drum cartridge according to the present embodiment.

With reference to FIG. 5 and FIG. 6, the drum cartridges 9 in the present embodiment are described.

FIG. 5 is an explanatory view of the configuration of the drum cartridges 9 (9Y, 9M, 9C, and 9K). The drum cartridges 9Y, 9M, 9C, and 9K have the same configuration except for toner colors (yellow (Y), magenta (M), cyan (C), and black (K)) that are used in the drum cartridges 9Y, 9M, 9C, and 9K. In the present embodiment, in an insertion direction of the drum cartridges 9 and the developing cartridges 4 to be described later, the upstream side and the downstream side of the insertion direction are defined as the front side and the back side, respectively. The photosensitive drum 1 is rotationally provided to a cleaning frame 27 of the drum cartridge 9 (9Y, 9M, 9C, or 9K) via a drum-front bearing 10 and a drum-back bearing 11. A drum coupling 16 and a flange are provided at one end of the photosensitive drum 1 in an axial direction thereof.

FIG. 6 is a schematic sectional view of the drum cartridge 9. As described above, the charging roller 2 and the cleaning member 6 are provided in the vicinity of the photosensitive drum 1. The photosensitive drum 1 drives to rotate on the basis of image forming operation when the drum cartridge 9 receives driving force transmitted from an apparatus drive motor (not shown), which is a driving source. The charging roller 2 is rotationally attached to the drum cartridge 9 via a charging roller bearing 28. The charging roller 2 is pressurized toward the photosensitive drum 1 by a charging roller pressurizing member 33, which is a spring, for example, and rotates along rotation of the photosensitive drum 1. The cleaning member 6 includes an elastic member 7 made up of a rubber blade, and a cleaning supporting member 8. A leading-edge portion 7*a* of the elastic member 7 is arranged to be in contact with the photosensitive drum 1 while being directed to a direction opposite to the rotation direction (clockwise direction in FIG. 6) of the photosensitive drum 1. Residual toner removed from the surface of the photosensitive drum 1 by the cleaning member 6 is dropped off to a removed toner chamber 27*a*. A squeegee sheet 21 configured to prevent leakage of removed toner from the removed toner chamber 27*a* is in contact with the photosensitive drum 1.

Developing Cartridge

Figure 7:
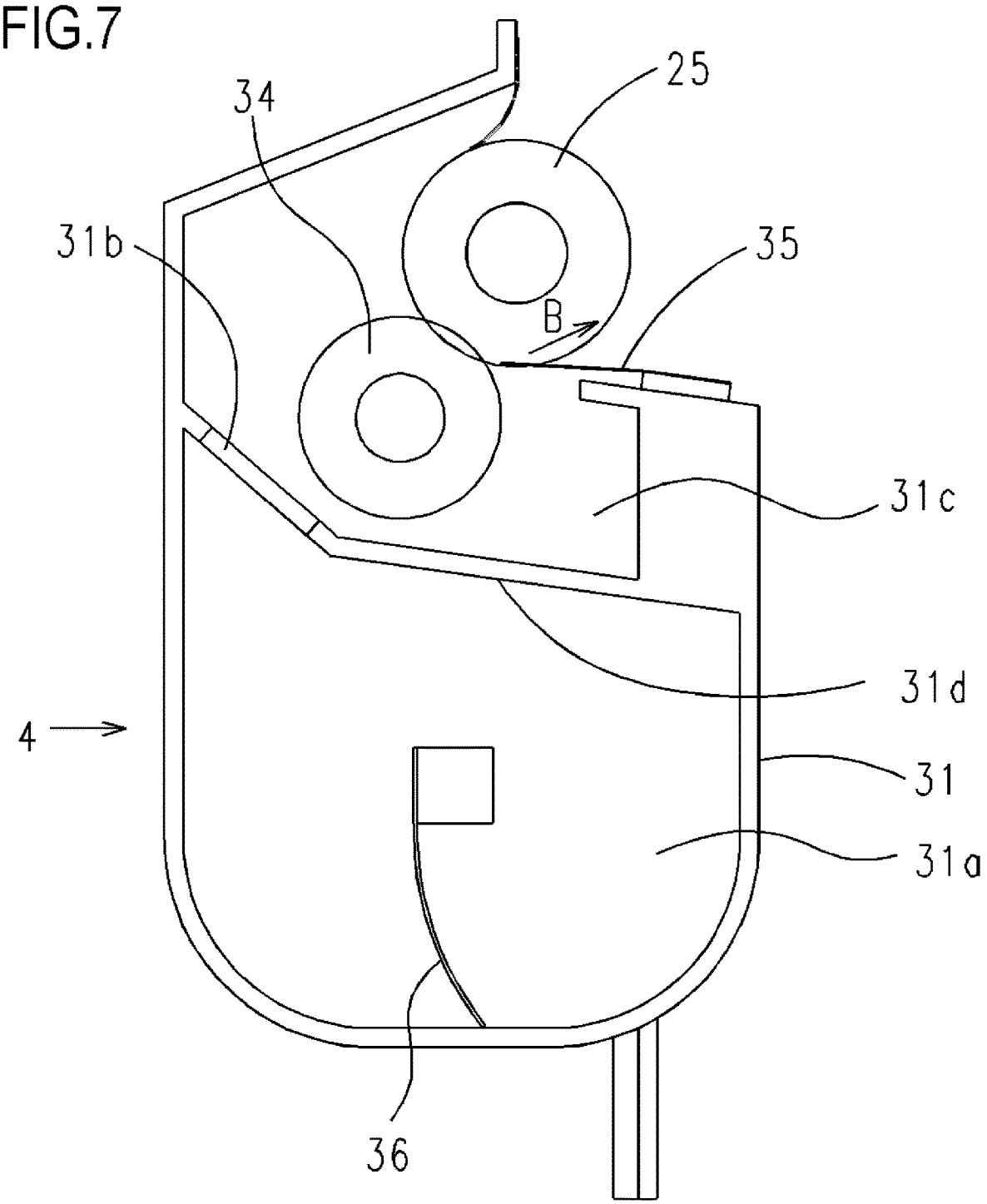
FIG. 7 is a main sectional view of a developing cartridge according to the present embodiment.

With reference to FIG. 7, the developing cartridges 4 according to the present embodiment are described. FIG. 7 is a schematic main sectional view of the developing cartridge 4 (4Y, 4M, 4C, or 4K) in which toner is stored. The developing cartridges 4Y, 4M, 4C, and 4K have the same configuration except for the colors of stored toner. Specifically, the developing cartridge 4Y having yellow toner stored therein, the developing cartridge 4M having magenta toner stored therein, the developing cartridge 4C having cyan toner stored therein, and the developing cartridge 4K having black toner stored therein have the same configuration.

The developing cartridge 4 includes the developing roller 25, a toner supplying roller 34, the developing blade 35, a toner conveying member 36, and a developing frame 31 configured to support these components. The developing roller 25 rotates in a direction of the arrow B while being in contact with the photosensitive drum 1. The toner supplying roller 34 rotates while being in contact with the developing roller 25. The developing blade 35 controls a toner layer on the developing roller 25. The space inside the developing frame 31 is partitioned by a partition wall 31*d* into a developing chamber 31*c* in which the developing roller 25 and the toner supplying roller 34 are arranged, and a toner storing chamber 31*a* provided below the developing chamber 31*c*. The partition wall 31*d* has an opening portion 31*b* through which toner passes when the toner is conveyed from the toner storing chamber 31*a* to the developing chamber 31*c*. The developing roller 25 and the toner supplying roller 34 are each rotationally supported by the developing frame 31 at both the ends thereof in the axial direction of the developing roller 25, via a developing-front bearing and a developing-back bearing provided to the developing frame 31. The toner conveying member 36 is provided to rotate in the toner storing chamber 31*a* in the developing frame 31. The toner conveying member 36 stirs toner stored in the toner storing chamber 31*a* and conveys toner to the developing chamber 31*c* through the opening portion 31*b*.

Figure 8:
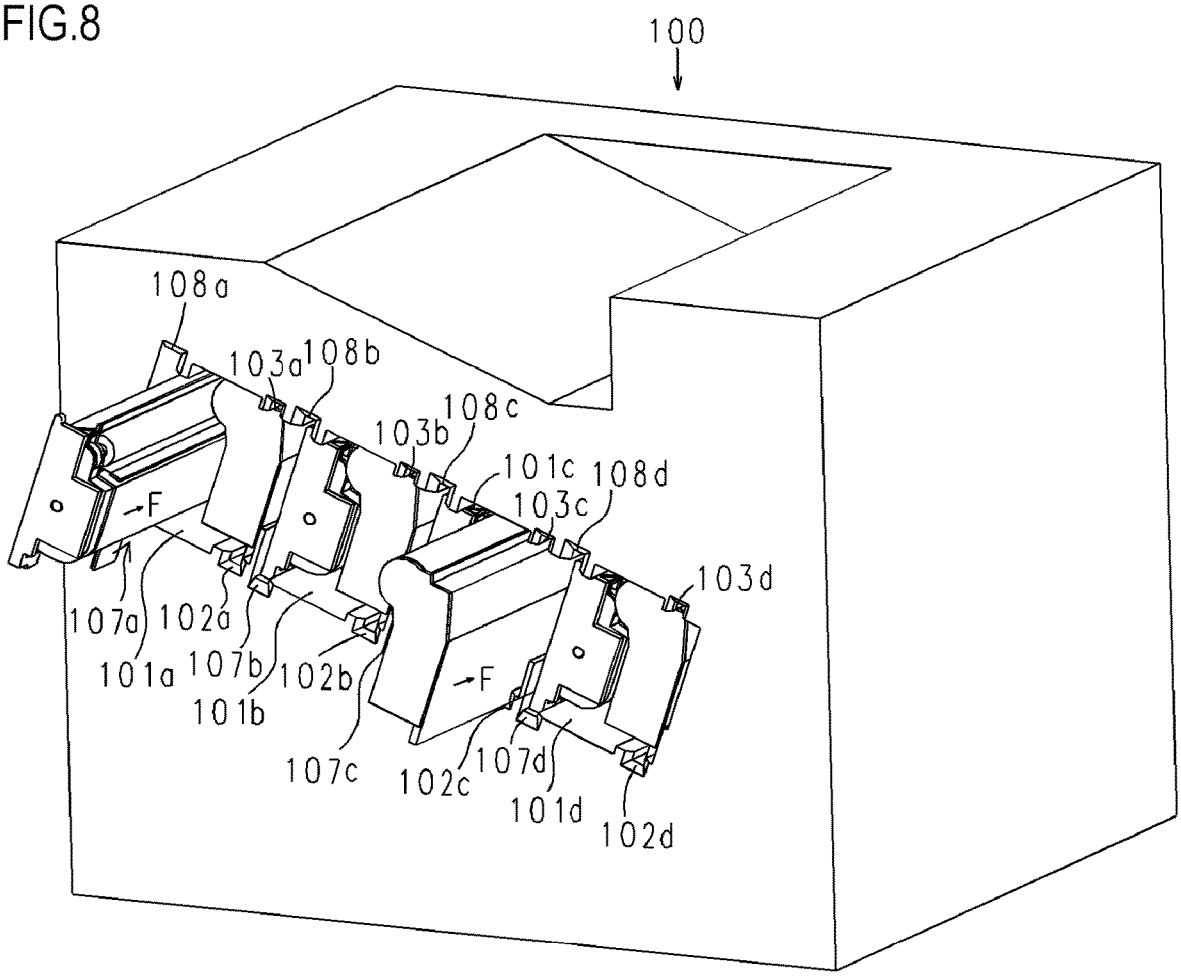
FIG. 8 is a configuration diagram illustrating how the drum cartridge and the developing cartridge according to the present embodiment are mounted.
Figure 9B:
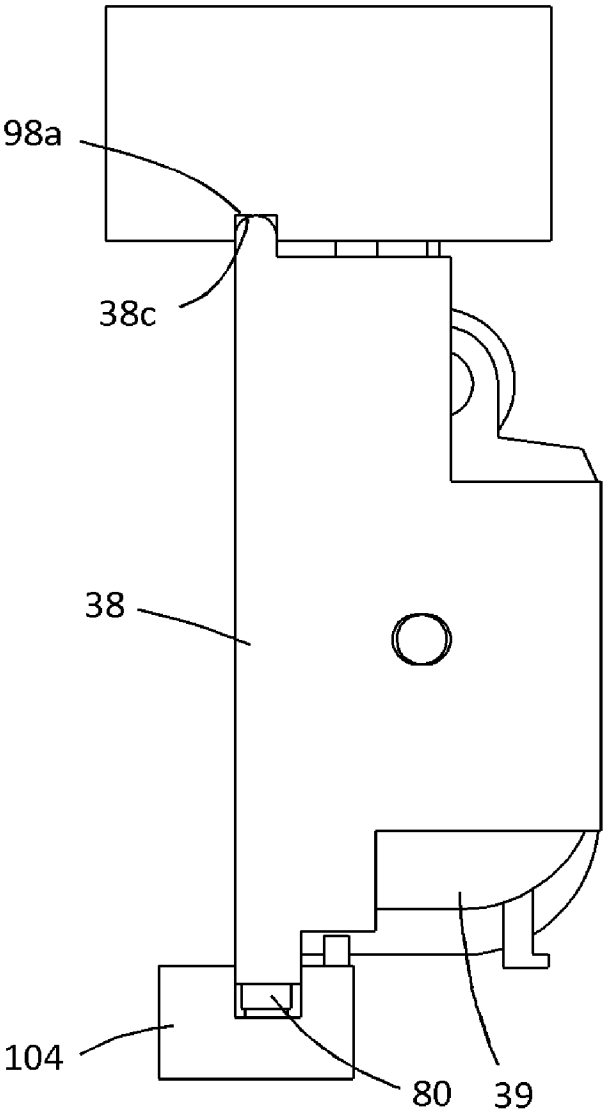
FIG. 9A and FIG. 9B are explanatory views illustrating the mounting situations of the developing cartridge according to the present embodiment.
Figure 9A:
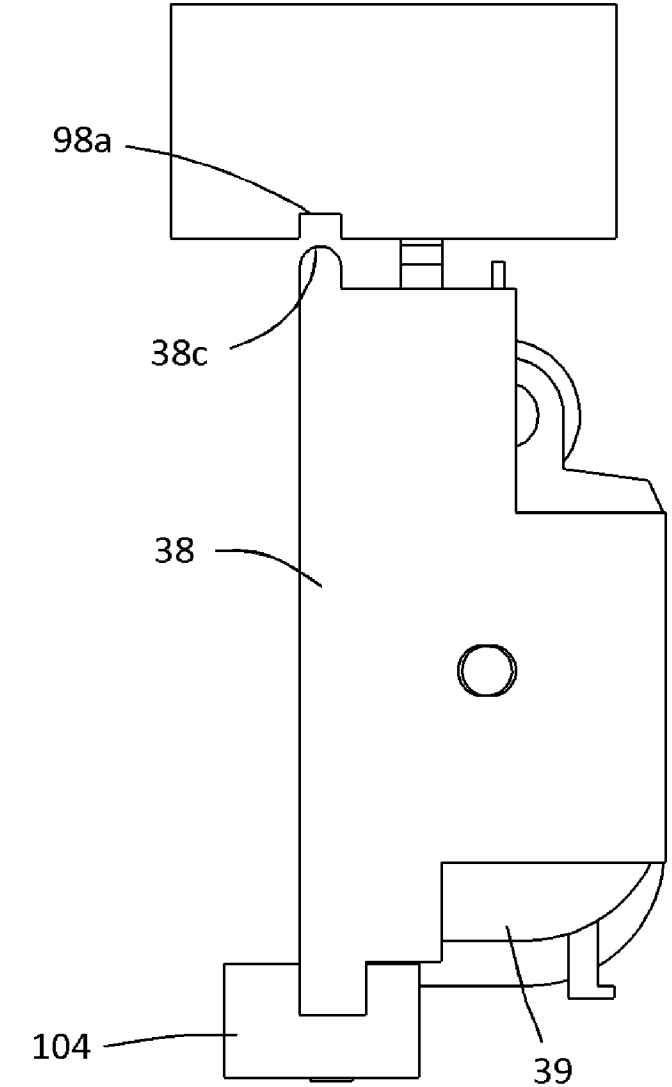

Insertion and Mounting of Drum Cartridge and Developing Cartridge to Image Forming Apparatus With reference to FIG. 8, FIG. 9A, and FIG. 9B, how the drum cartridges 9 and the developing cartridges 4 are inserted and mounted to the image forming apparatus 100 is described. The image forming apparatus 100 according to the present embodiment has, in the apparatus main body, opening portions 101 (101*a*, 101*b*, 101*c*, and 101*d*) into which the drum cartridges 9 (9Y, 9M, 9C, and 9K) and the developing cartridges 4 (4Y, 4M, 4C, and 4K) are inserted. The opening portions 101 are formed on the front side of the apparatus main body, and the drum cartridges 9 and the developing cartridges 4 are inserted into the apparatus main body from the front side to the back side in the horizontal direction (a direction of the arrow F in FIG. 8) parallel to a surface on which the image forming apparatus 100 is installed. When the drum cartridge 9 is mounted to the apparatus main body, the axial direction of the photosensitive drum 1 is parallel to the horizontal direction (the direction of the arrow F in FIG. 8). In the present embodiment, the upstream side and the downstream side of the insertion direction of the drum cartridges 9 and the developing cartridges 4 are defined as the front side and the back side, respectively.

Inside the apparatus main body, drum cartridge upper guide portions 103 (103*a*, 103*b*, 103*c*, and 103*d*) for mounting to the main body are provided on the upper side, and drum cartridge lower guide portions 102 (102*a*, 102*b*, 102*c*, and 102*d*) for mounting to the main body are provided on the lower side. The drum cartridge upper guide portions 103 for mounting to the main body and the drum cartridge lower guide portions 102 for mounting to the main body each have a guide shape extended along the insertion direction F of the drum cartridges 9. When the drum cartridge 9 is inserted into the apparatus main body, the drum cartridge 9 is placed on the front side of the drum cartridge lower guide portion 102 for mounting to the main body in the mounting direction, and is then moved in the insertion direction F along the drum cartridge upper guide portion 103 for mounting to the main body and the drum cartridge lower guide portion 102 for mounting to the main body.

The developing cartridges 4 are inserted similarly to the drum cartridges 9. Specifically, inside the apparatus main body, developing cartridge upper guide portions 108 (108*a*, 108*b*, 108*c*, and 108*d*) for mounting to the main body are provided on the upper side, and developing cartridge lower guide portions 107 (107*a*, 107*b*, 107*c*, and 107*d*) for mounting to the main body are provided on the lower side. When the developing cartridge 4 is inserted into the apparatus main body, the developing cartridge 4 is placed on the front side of the developing cartridge lower guide portion 107 for mounting to the main body in the mounting direction, and is then moved in the insertion direction F along the developing cartridge upper guide portion 108 for mounting to the main body and the developing cartridge lower guide portion 107 for mounting to the main body.

FIG. 9A and FIG. 9B are schematic views of the developing cartridge 4 and part of the configuration of the apparatus main body when seen from the front side to the back side in the mounting direction. FIG. 9A illustrates a state where the developing cartridge 4 is being inserted into the apparatus main body and FIG. 9B illustrates a state where the insertion is complete. FIG. 9A illustrates a state where the developing cartridge 4 is being inserted and is positioned below the image forming position, and FIG. 9B illustrates a state where the developing cartridge 4 has been completely inserted and raised to the image forming position. When being inserted, the developing cartridge 4 is positioned below the image forming position to secure a gap for preventing the developing cartridge 4 from being brought into contact with the transfer belt 14 (see FIG. 4). After the developing cartridge 4 is fully inserted, a lifting member 80 provided to each of the front side and the back side of the lower guide portion 107 for mounting to the main body rises to raise the developing cartridge 4. In this way, the developing cartridge 4 is raised to the image forming position.

Description on Configuration of End Portion Member of Developing Cartridge

Figure 10:
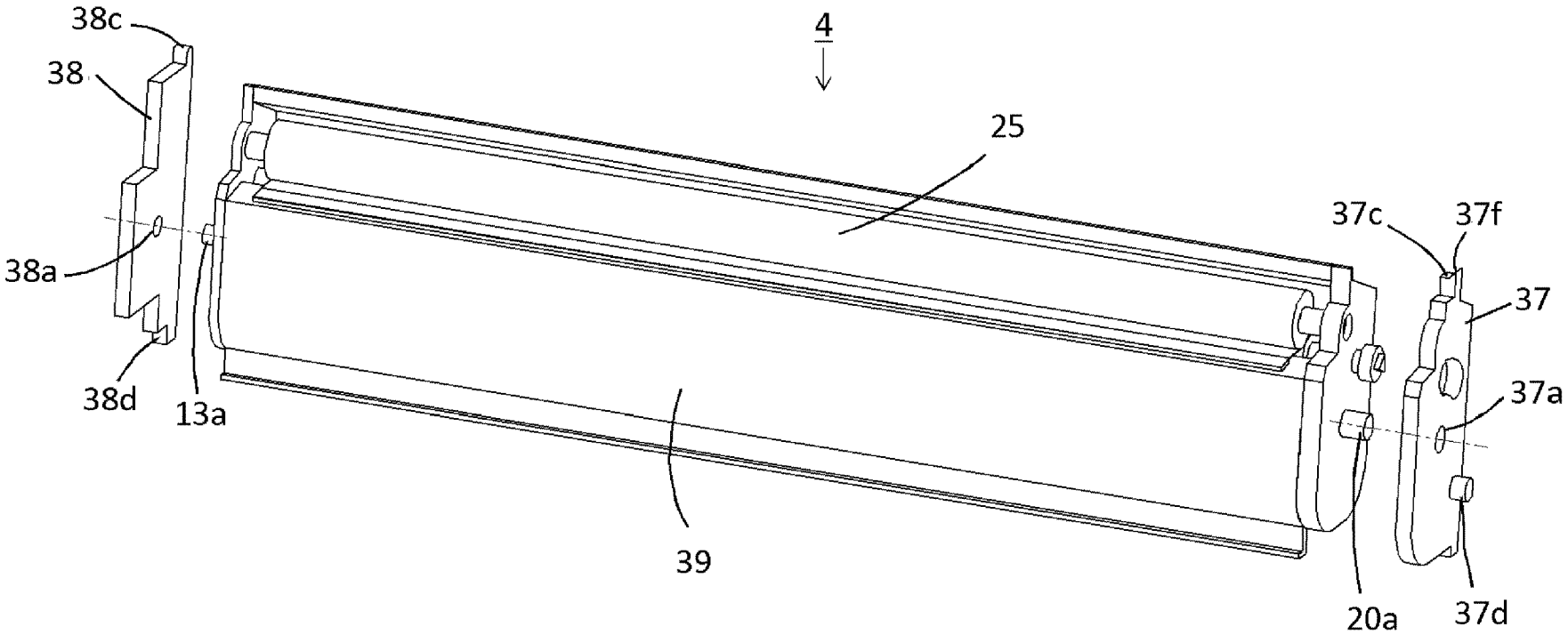
FIG. 10 is a configuration diagram illustrating an end portion member of the developing cartridge according to the present embodiment.
Figure 11:
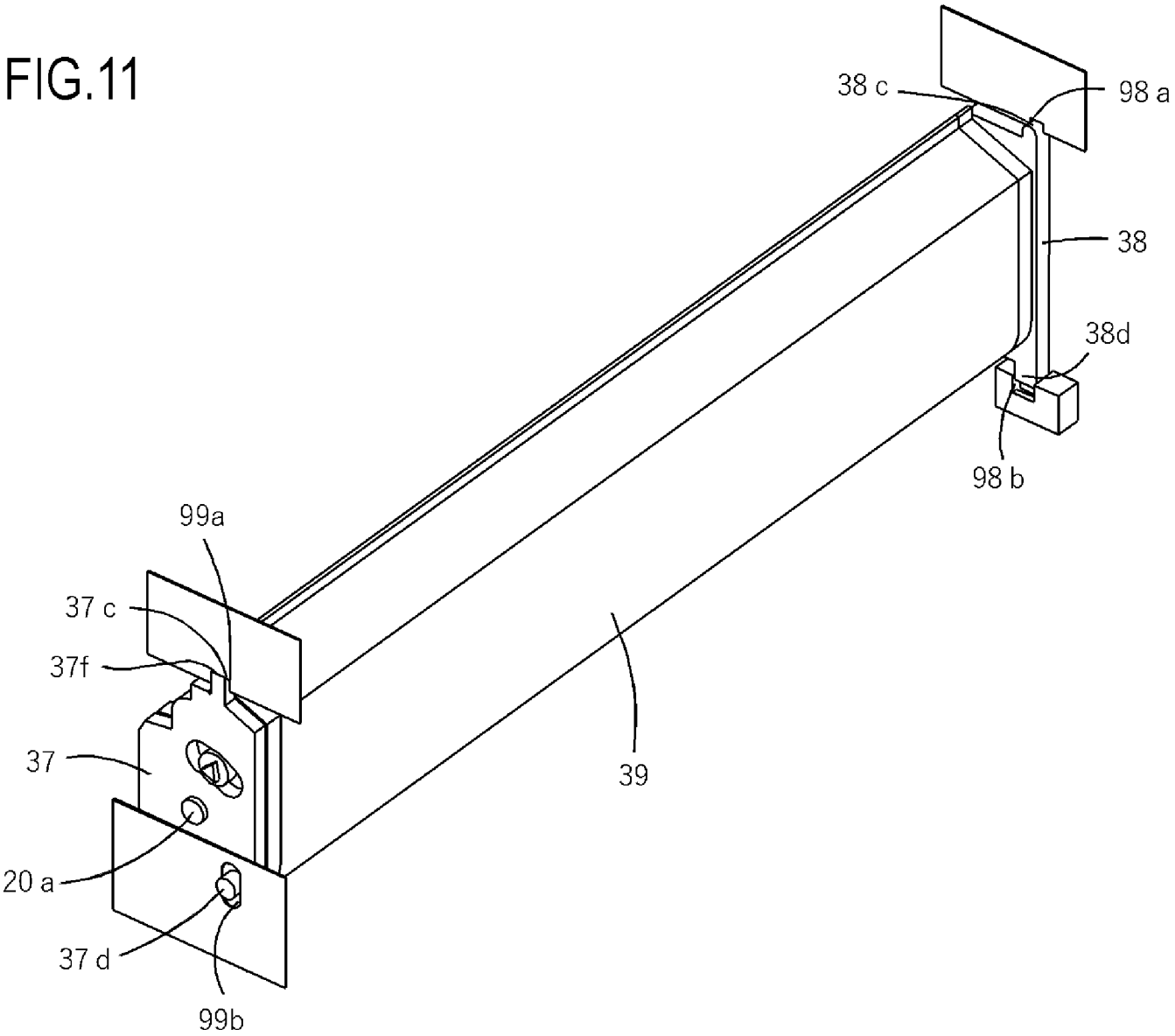
FIG. 11 is a perspective view illustrating the mounting state of the developing cartridge according to the present embodiment.

With reference to FIG. 10 and FIG. 11, the configuration of the developing cartridge 4 of the present embodiment is described.

FIG. 10 is a schematic exploded perspective view illustrating how a first end portion member 37 and a second end portion member 38 are supported with respect to a developing unit 39.

The developing frame 31 of the developing cartridge 4 includes the developing unit 39 including the constituent members such as the developing roller 25, the first end portion member 37 provided at one end of the developing unit 39 in the axial direction of the developing roller 25, and the second end portion member 38 provided at the other end thereof. The developing unit 39 includes the constituent members such as the developing roller 25, and a frame configured to support the constituent members. The developing unit 39 has a first boss 20*a* serving as a first fulcrum for rotationally coupling the first end portion member 37, and a second boss 13*a* serving as a second fulcrum for rotationally coupling the second end portion member 38. The first end portion member 37 has a first pivot center (hole) 37*a* that is engaged with the first boss 20*a* provided to the developing unit 39. Further, the second end portion member 38 has a second pivot center (hole) 38*a* that is engaged with the second boss 13*a* provided to the developing unit 39. With these engaging configurations, the first end portion member 37 and the second end portion member 38 can move (rotate) independently of each other relative to the developing unit 39 around the rotation axis of the developing roller 25. The first end portion member 37 has a first positioning portion 37*c* and a first rotation-stopping portion 37*d* for positioning the first end portion member 37 in the apparatus main body of the image forming apparatus 100. Further, the second end portion member 38 has a second positioning portion 38*c* and a second rotation-stopping portion 38*d* for positioning the second end portion member 38 in the apparatus main body of the image forming apparatus 100.

FIG. 11 is a perspective view illustrating a state where the developing cartridge 4 is positioned in the apparatus main body of the image forming apparatus 100. After the insertion into the apparatus main body is complete, the developing cartridge 4 is raised to the image forming position so that the first positioning portion 37*c* and the first rotation-stopping portion 37*d* are respectively engaged with a first main body-side positioning portion 99*a* and a first main body-side rotation-stopping portion 99*b* provided to the apparatus main body. With this, the first end portion member 37 is positioned in the apparatus main body of the image forming apparatus 100. In a similar manner, after the insertion into the apparatus main body is complete, the developing cartridge 4 is raised to the image forming position so that the second positioning portion 38*c* and the second rotation-stopping portion 38*d* are respectively engaged with a second main body-side positioning portion 98*a* and a second main body-side rotation-stopping portion 98*b* provided to the apparatus main body. With this, the second end portion member 38 is positioned in the apparatus main body of the image forming apparatus 100.

The developing unit 39 configured to support the developing roller 25 and other components is arranged to the first end portion member 37 and the second end portion member 38 positioned in the apparatus main body of the image forming apparatus 100 so that the developing unit 39 can move (rotate) relative to the first end portion member 37 and the second end portion member 38. Through movement relative to the first end portion member 37 and the second end portion member 38 positioned in the apparatus main body, the developing unit 39 can move in a direction toward or away from the photosensitive drum 1 positioned in the apparatus main body. Thus, the developing roller 25 supported by the developing unit 39 can be brought into contact with or separated from the photosensitive drum 1.

In this way, in the present embodiment, the first end portion member 37 and the second end portion member 38 are configured as the individual members to serve as a frame configuration for rotationally supporting the developing unit 39 configured to support the developing roller 25 and other components. The first end portion member 37 and the second end portion member 38 can move independently of each other relative to the developing unit 39, and the developing unit 39 is positioned in the apparatus main body through positioning of the first end portion member 37 and the second end portion member 38 in the apparatus main body. Consequently, a member configured to couple the first end portion member 37 and the second end portion member 38, which is provided in related art, is unnecessary, and the developing cartridge 4 can therefore be reduced in size compared to a case where the first end portion member 37 and the second end portion member 38 are integrated. As a result, the entire image forming apparatus can be reduced in size.

Description on Rotation Preventing Configuration of First End Portion Member

Figure 1:
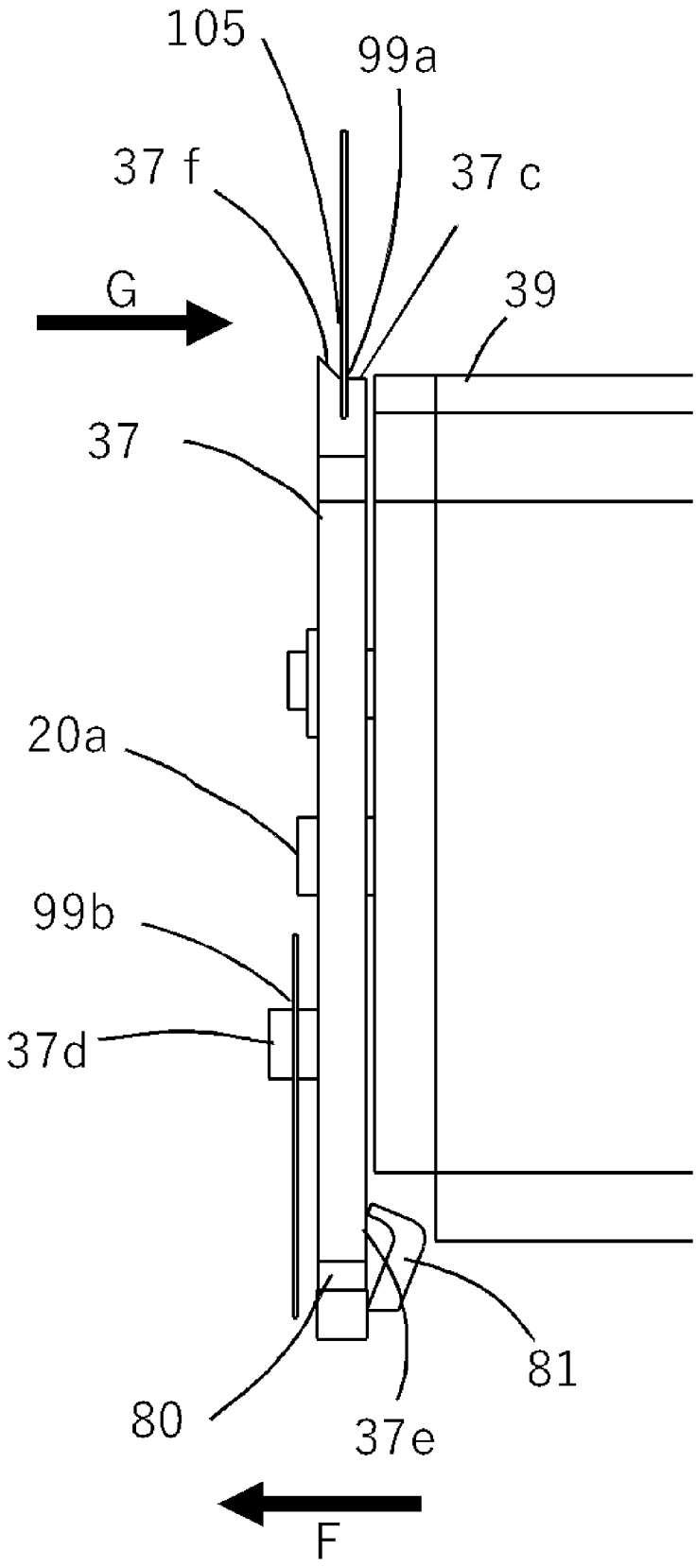
FIG. 1 is a configuration diagram illustrating a developing cartridge according to an embodiment of the present invention.
Figure 12:
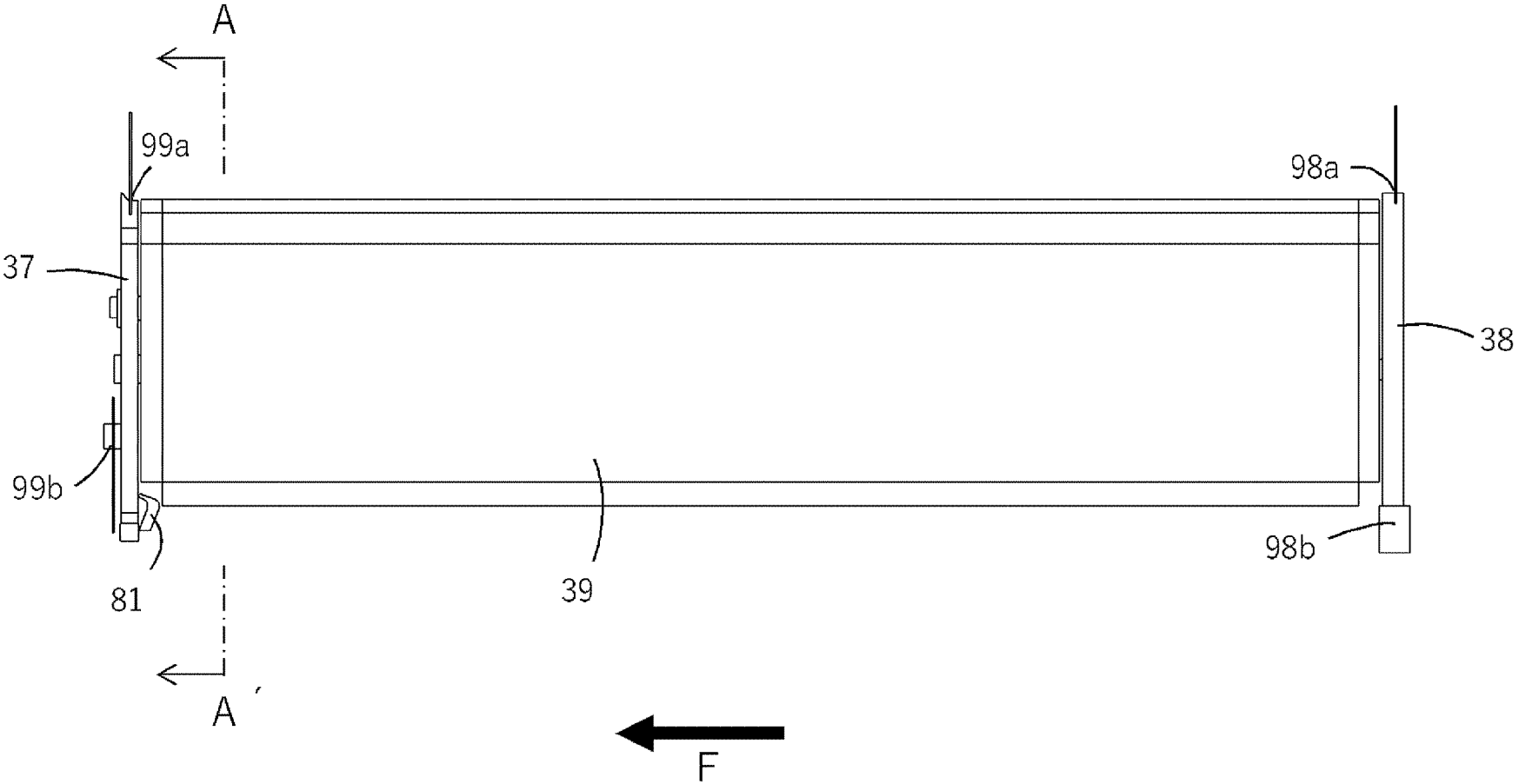
FIG. 12 is an overall view illustrating the mounting state of the developing cartridge according to the present embodiment.
Figure 13:
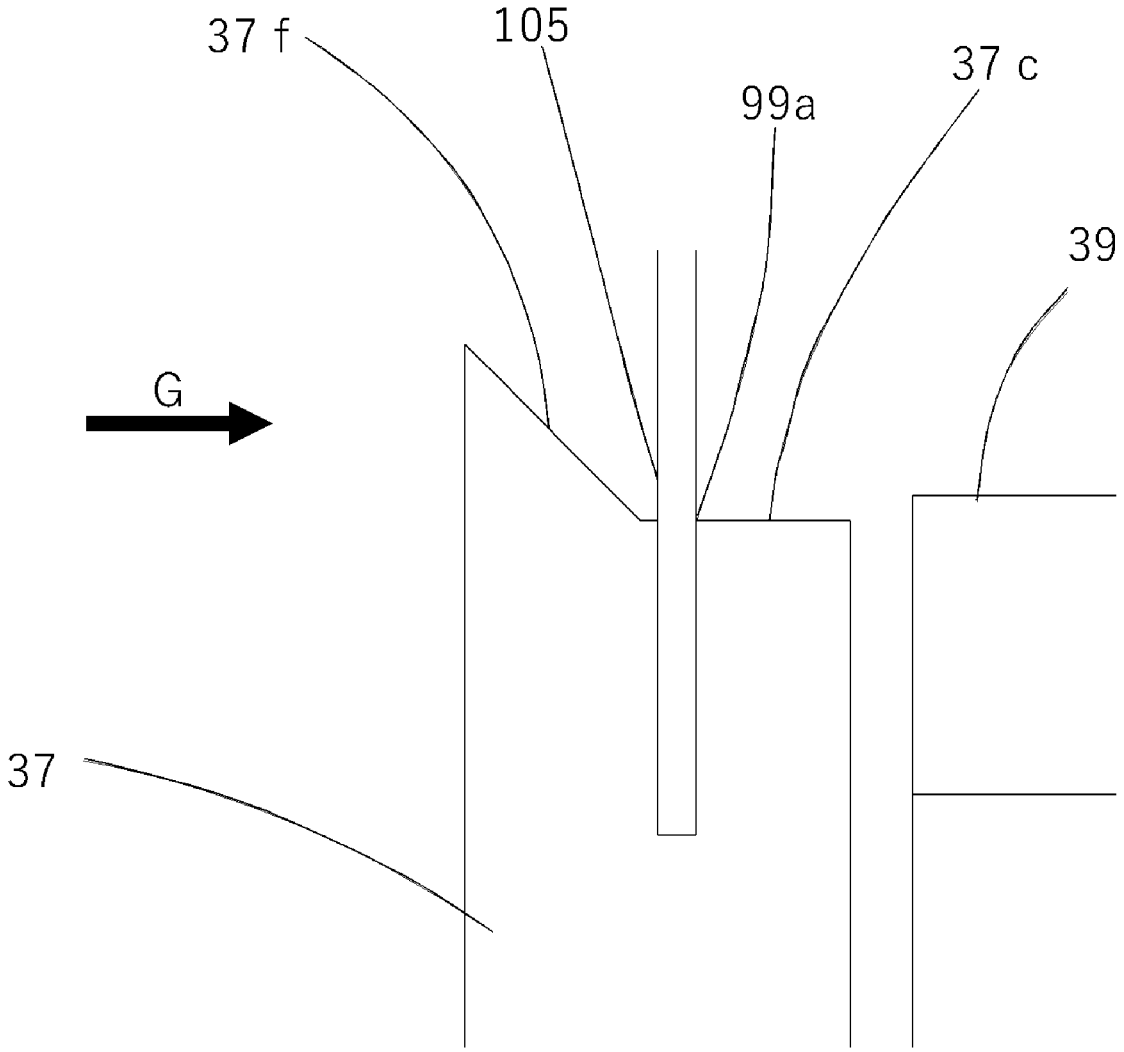
FIG. 13 is an enlarged view illustrating a regulating portion of the developing cartridge according to the present embodiment.

With reference to FIG. 1, FIG. 12, and FIG. 13, the configuration of the first end portion member 37 is described in detail. FIG. 12 is an overall view of a state where the developing cartridge 4 is positioned in the apparatus main body of the image forming apparatus 100 when seen from a direction orthogonal to the axis of the developing roller 25. FIG. 1 is an enlarged view obtained by enlarging a side (left side) indicated by the arrows of the line A-A' of FIG. 12, and illustrates the configuration in the vicinity of the first end portion member 37. FIG. 13 is an enlarged view obtained by enlarging the vicinity of a regulating portion 37*f* illustrated in FIG. 1.

The developing cartridge 4 is mounted to the apparatus main body of the image forming apparatus 100 in the direction of the arrow F to be positioned. As described above, when the developing cartridge 4 is mounted inside the apparatus main body to reach the back side in the mounting direction F, the developing cartridge 4 is raised to the image forming position, and the first positioning portion 37*c* and the first rotation-stopping portion 37*d* are engaged with the first main body-side positioning portion 99*a* and the first main body-side rotation-stopping portion 99*b*, respectively. Under such a state, a pressurizing portion 81 (biasing member) provided to the apparatus main body is brought into abutment against a force receiving portion 37*e* provided to the front-side side-surface of the first end portion member 37, thereby applying force to the force receiving portion 37*e* in the direction of the mounting direction F. The pressurizing portion 81 biases the force receiving portion 37*e* with biasing force from a spring (not shown), for example, so that the first end portion member 37 is fixed to the apparatus main body in the axial direction of the developing roller 25. With this, the developing cartridge 4 is prevented from moving relative to the apparatus main body in the axial direction of the developing roller 25 when an image is formed or the developing cartridge 4 is conveyed while being mounted in the apparatus main body. In the first end portion member 37, the force receiving portion 37*e* is positioned on the lower side in the gravity direction of the first pivot center (hole) 37*a* with which the first boss 20*a* is engaged. The lower side corresponds to a first side (one side) in a direction (first direction) orthogonal to the rotation axis of the first end portion member 37.

In the first end portion member 37, the regulating portion 37*f*, which is a feature of the present embodiment, is provided on the upper side in the gravity direction of the first pivot center (hole) 37*a* with which the first boss 20*a* of the developing unit 39 is engaged. The upper side corresponds to a second side (another side) in a direction (first direction) orthogonal to the rotation axis of the first end portion member 37. The regulating portion 37*f* is provided on the back side of the first positioning portion 37*c* in the mounting direction F and is positioned on the back side in the mounting direction F (the outer side of the developing roller 25 in the axial direction) of a main body regulating surface 105 that is the side wall of the first main body-side positioning portion 99*a* on the back side in the mounting direction F, on the frame of the apparatus main body. The regulating portion 37*f* has a shape with a surface gradually inclined upward from the first positioning portion 37*c* in the mounting direction F, and faces the main body regulating surface 105 in a direction opposite to the mounting direction F. Having the inclined shape, the regulating portion 37*f* has a portion that may be brought into abutment against the frame (first main body-side positioning portion 99*a*) of the apparatus main body at a position farther from the rotation axis of the first end portion member 37 than a position at which the first positioning portion 37*c* is brought into abutment against the frame. Thus, depending on the posture of the first end portion member 37 when the developing cartridge 4 is raised to the image forming position, the regulating portion 37*f* may be brought into contact with the first main body-side positioning portion 99*a* before the first positioning portion 37*c* is brought into contact with the first main body-side positioning portion 99*a*. In this case, with the above-mentioned inclined shape, the first main body-side positioning portion 99*a* slides on the regulating portion 37*f* to be guided to the position at which the first main body-side positioning portion 99*a* is engaged with the first positioning portion 37*c*.

When the force receiving portion 37*e* receives force from the pressurizing portion 81, in the first end portion member 37, rotational moment acting in a direction of the arrow G of FIG. 1 is generated with a rotation fulcrum being the first pivot center (hole) 37*a* with which the first boss 20*a* of the developing unit 39 is engaged. The first boss 20*a* and the first pivot center (hole) 37*a* are supported by each other with a slight gap therebetween, which allows their relative movement. Because the slight gap is secured in the support portion, when the rotational moment in the direction of the arrow G is generated, the first end portion member 37 tries to rotate in the direction of the arrow G (change its posture to incline) with a center (fulcrum) being the first pivot center (hole) 37*a*. At this time, in the first end portion member 37, a portion on a side (one side) on which the force receiving portion 37*e* is provided and a portion on the opposite side (another side), which are defined with a boundary being the first pivot center (hole) 37*a*, try to move in a direction opposite to the direction (mounting direction F) in which the force receiving portion 37*e* receives force from the pressurizing portion 81. This movement is, however, regulated by the regulating portion 37*f* being brought into contact with the main body regulating surface 105, and the above-mentioned rotation of the first end portion member 37 is regulated. Through regulation of the rotation of the first end portion member 37, the first end portion member 37 can be prevented from being brought into contact with the developing unit 39, which means that the developing unit 39 can perform contact operation without the contact preventing the contact operation. The contact operation can be performed without being prevented, and hence the contact state between the developing roller 25 and the photosensitive drum 1 can be stabilized, that is, the image quality can be stabilized.

Comparative Example

What may happen if the above-mentioned regulating portion 37*f* is not provided is hereinafter described by taking a configuration without the regulating portion 37*f* as a comparative example.

Figure 2:
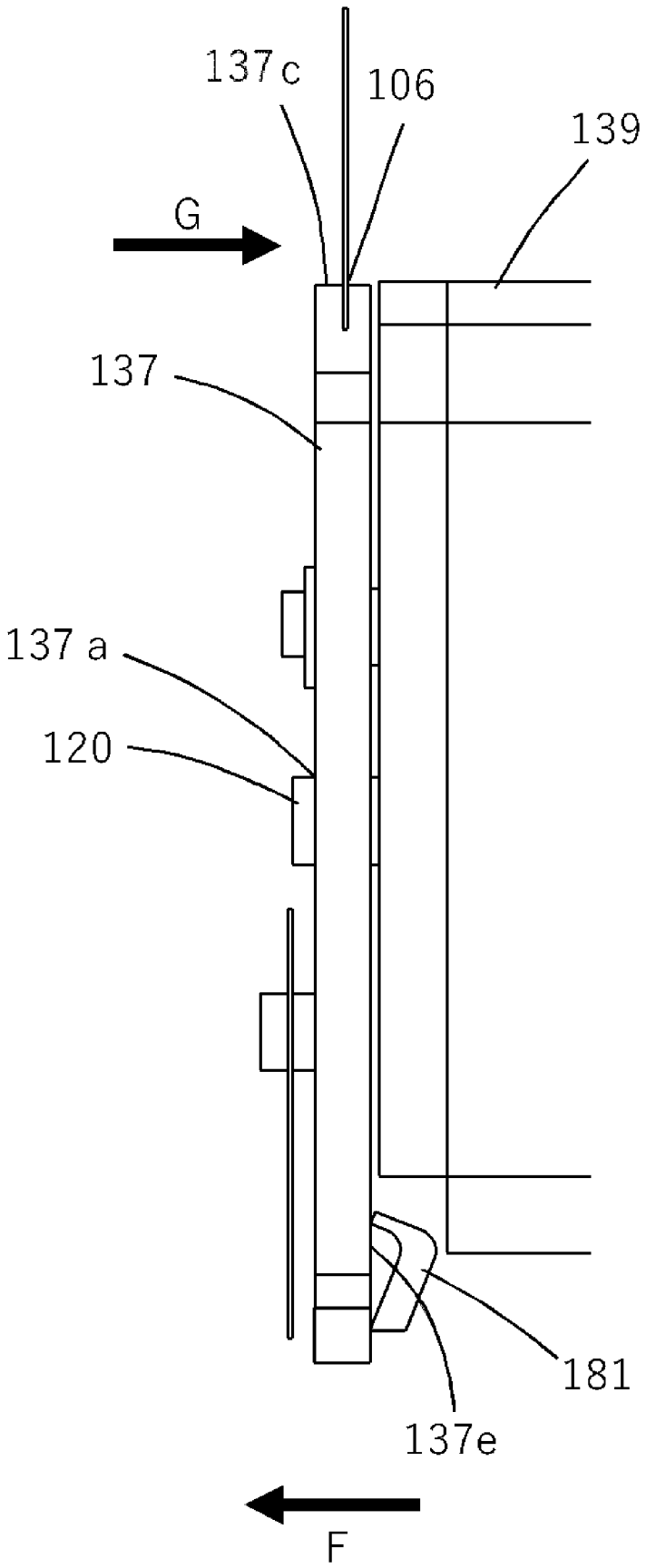
FIG. 2 is an enlarged view of the vicinity of an end portion member of a developing apparatus according to a comparative example.

FIG. 2 is a schematic enlarged view of the vicinity of a first end portion member 137 when seen from a direction orthogonal to the axis of a developing roller, under a state where a developing apparatus according to a comparative example is positioned in the apparatus main body of the image forming apparatus 100. The first end portion member 137 is attached to a developing unit 139 so that the first end portion member 137 and the developing unit 139 are movable relatively to each other. The first end portion member 137 and the developing unit 139 are supported as follows: a first pivot center (hole) 137*a* of the first end portion member 137 is supported with respect to a rotation boss 120 provided to the developing unit 139 in a relatively movable manner. A first positioning portion 137*c* provided to the first end portion member 137 is engaged with a first main body-side positioning portion 106 of the image forming apparatus to be positioned in the image forming apparatus. The first positioning portion 137*c* is arranged above the first pivot center 137*a*.

Also in the developing apparatus according to the comparative example, the first end portion member 137 is fixed to the apparatus main body by being biased by a pressurizing portion 181 in the direction of the arrow F, which is the developing apparatus mounting direction. The pressurizing portion 181 of the apparatus main body biases a pressure receiving portion 137*e* of the first end portion member 137. The pressure receiving portion 137*e* is positioned below the first rotation center (hole) 137*a* with which the rotation boss 120 of the developing unit 139 is engaged.

Figure 3:
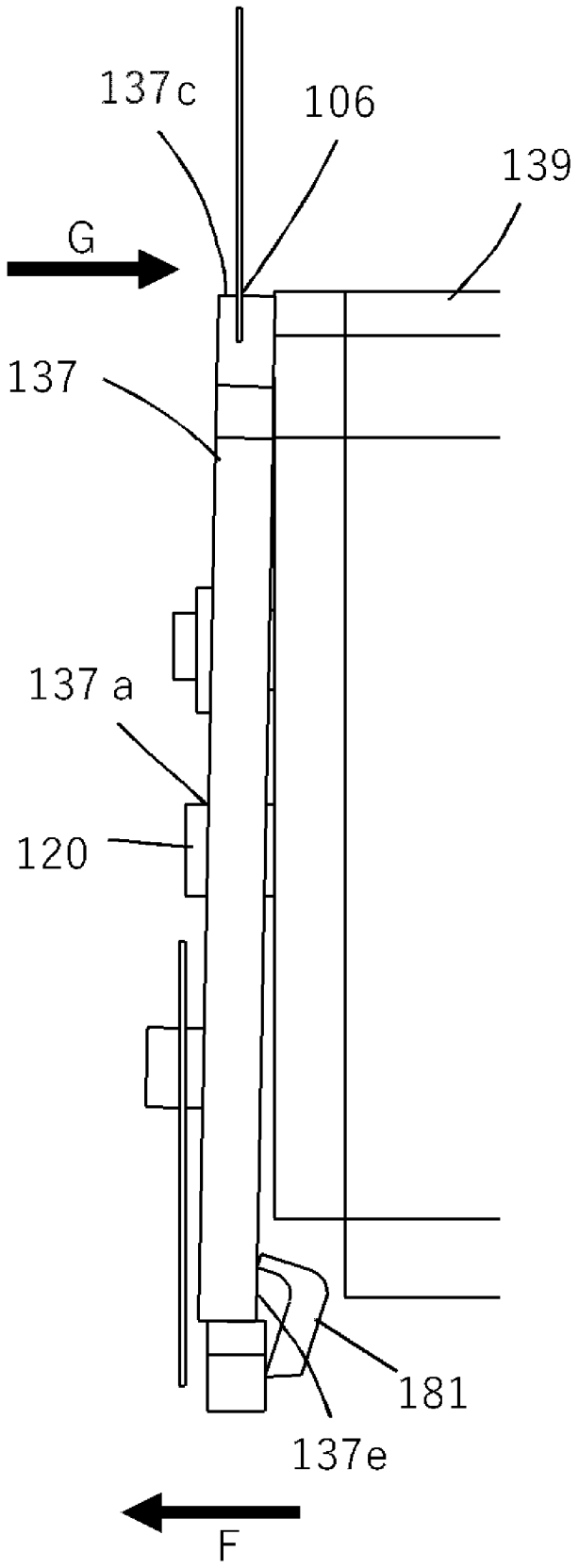
FIG. 3 is an enlarged view illustrating a problem of the end portion member of the developing apparatus according to the comparative example.

FIG. 3 is a schematic enlarged view illustrating a state where the first end portion member 137 rotates by being biased by the pressurizing portion 181 in the developing apparatus according to the comparative example. When the first end portion member 137 is fixed to the apparatus main body with the pressurizing portion 181 biasing the pressure receiving portion 137*e*, in the first end portion member 137, rotational moment acting in the direction of the arrow G is generated by biasing force from the pressurizing portion 181, with a fulcrum being the rotation boss 120 of the developing unit 139. The first end portion member 137 and the developing unit 139 are supported with a slight gap therebetween so that the first end portion member 137 and the developing unit 139 can move relatively to each other. Thus, when the rotational moment in the direction of the arrow G is generated, the first end portion member 137 rotates in the direction of the arrow G, with the fulcrum being the rotation boss 120. Consequently, the first end portion member 137 may be brought into contact with the developing unit 139. If the first end portion member 137 is brought into contact with the developing unit 139, the developing unit 139 is prevented from performing the contact operation of bringing the developing roller into contact with a photosensitive drum, and the developing roller supported by the developing unit 139 cannot be brought into contact with the photosensitive drum. As a result, image defects may occur.

Modified Example 1

Figure 14:
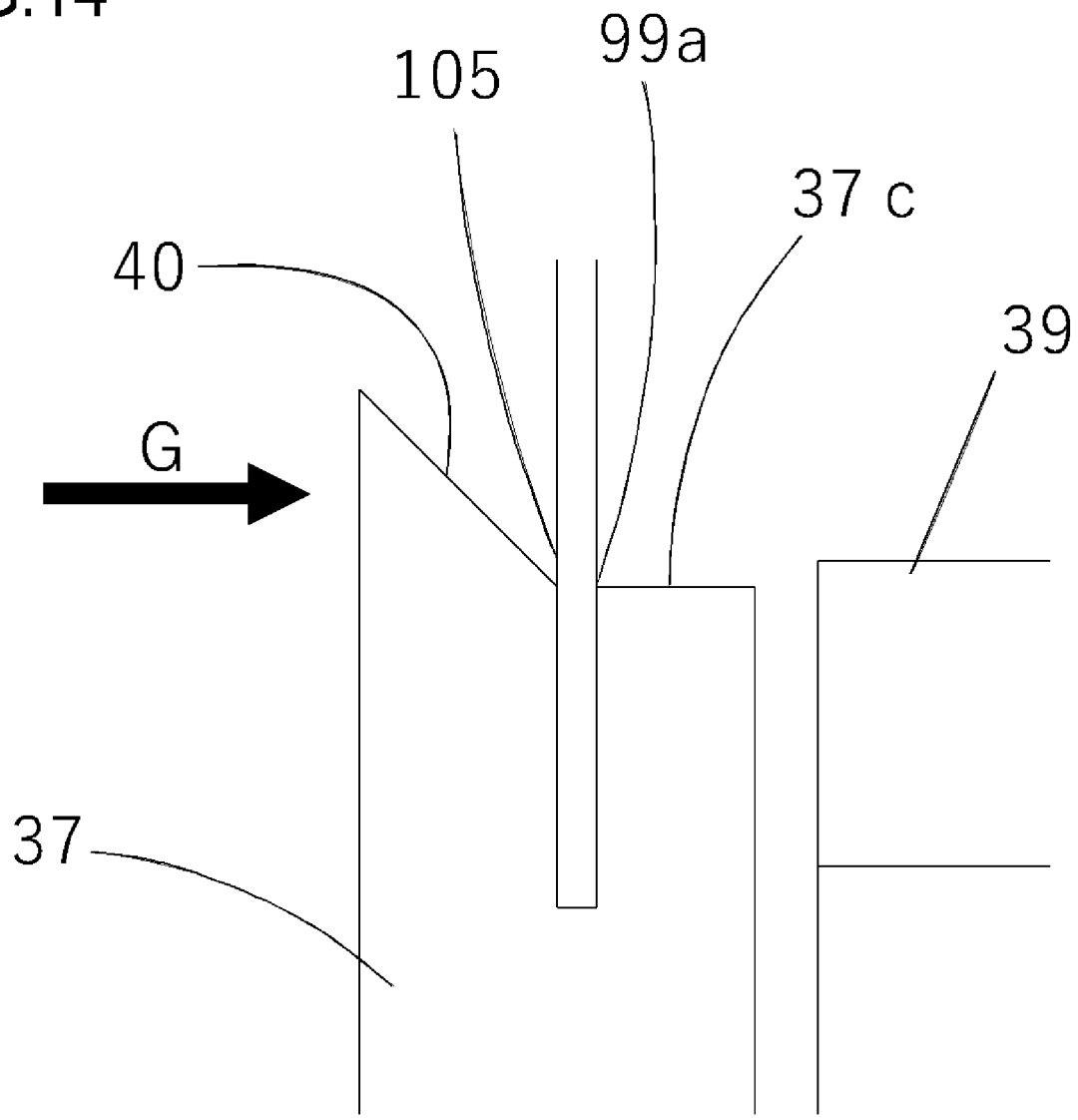
FIG. 14 is an explanatory view of a developing cartridge according to Modified Example 1.

Here, as illustrated in FIG. 14, the regulating portion 37*f* may be a first abutting portion 40 which is arranged toward the developing unit 39, and with which the main body regulating surface 105 is brought into contact when the developing cartridge 4 is raised to the image forming position. The regulating portion 37*f* of the present embodiment is not necessarily in contact with the main body regulating surface 105. The regulating portion 37*f* may face the main body regulating surface 105 with a slight gap therebetween and may be brought into contact with the main body regulating surface 105 only after the above-mentioned rotational moment is generated and the first end portion member 37 tries to change its posture. Meanwhile, the first abutting portion 40 of Modified Example 1 is configured to be in contact with the main body regulating surface 105 in the first place, specifically, before the above-mentioned rotational moment is generated and the first end portion member 37 tries to change its posture. That is, in this configuration, the regulating portion functions as an abutting portion that is brought into abutment against the apparatus main body when the developing cartridge 4 is positioned in the image forming apparatus 100. With such a configuration, similarly to the effect that the present embodiment provides, the rotation of the first end portion member 37 can be prevented and the image quality can therefore be stabilized.

Modified Example 2

Figure 15:
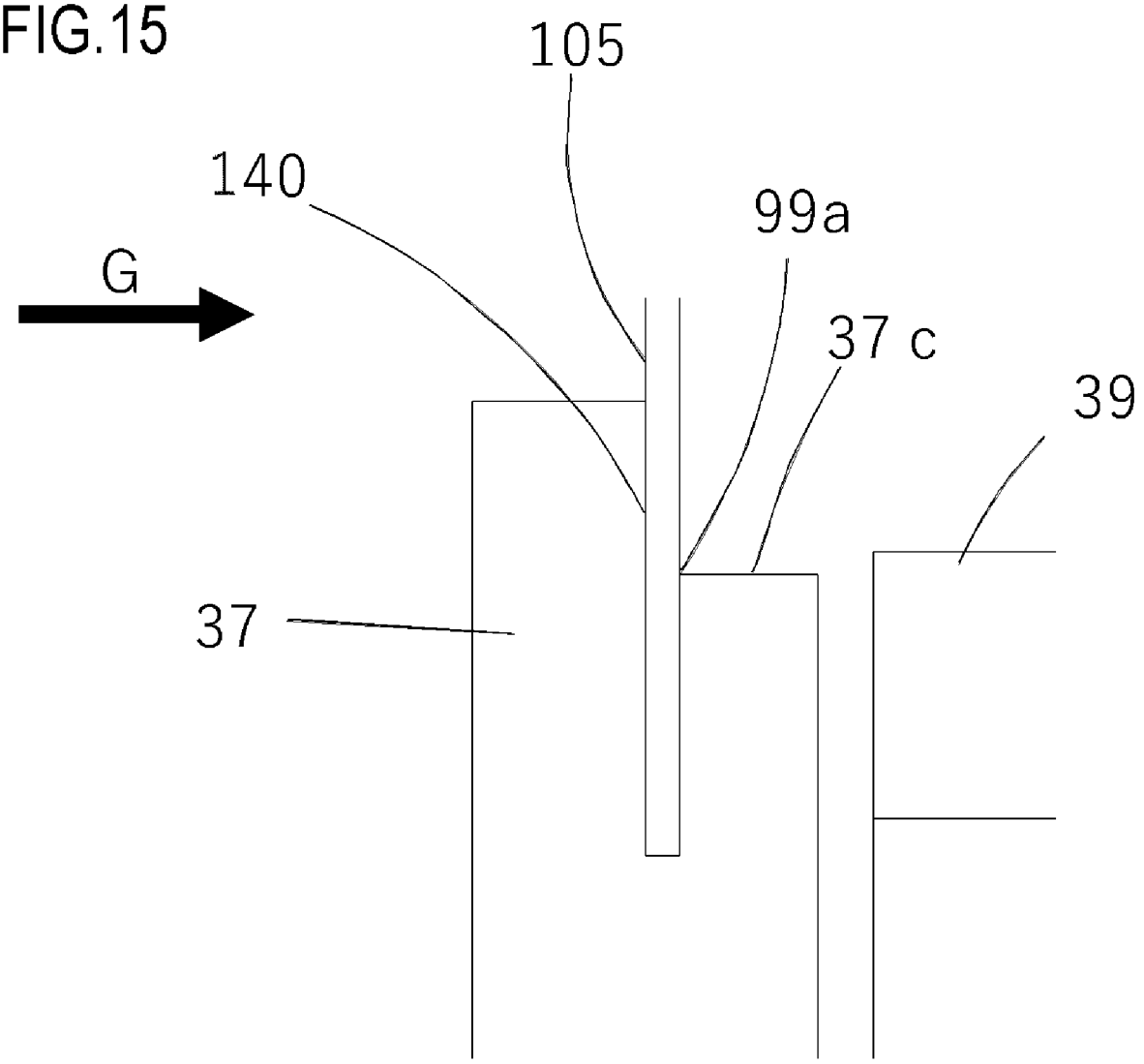
FIG. 15 is an explanatory view of a developing cartridge according to Modified Example 2.

The first abutting portion 40 illustrated in FIG. 14, which has an inclined shape, may be a first abutting portion 140 having a vertical surface as illustrated in FIG. 15.

As illustrated in FIG. 15, the first abutting portion 140 is positioned above the first rotation center (hole) 37*a* with which the first boss 20*a*, which is the rotation fulcrum of the first end portion member 37, is engaged. Moreover, the first abutting portion 140 is provided to face the developing unit 39 and is in contact with the main body regulating surface 105. Further, the first positioning portion 37*c* arranged upward, which serves as a second abutting portion, is brought into contact with the first main body-side positioning portion 99*a* in the direction orthogonal to the axis of the developing roller 25 to fix the first end portion member 37 to the apparatus main body. As in the present embodiment, when the force receiving portion 37*e* receives force from the pressurizing portion 81 and the rotational moment in the direction of the arrow G is generated, the rotation of the first end portion member 37 is regulated because the first abutting portion 140 is brought into abutment against the main body regulating surface 105. Further, the first positioning portion 37*c* facing upward is brought into contact with the first main body-side positioning portion 99*a* in the direction orthogonal to the axis of the developing roller 25, and hence the first end portion member 37 is fixed to the apparatus main body in the direction orthogonal to the axis of the developing roller 25. Thus, the first end portion member 37 is prevented from rotating in the axial direction of the developing roller 25 by the first abutting portion 140, and is positioned in the direction orthogonal to the axis of the developing roller 25 by the first positioning portion 37*c*, which is the second abutting portion. As a result, the developing unit 39 is not prevented from performing the contact operation to the photosensitive drum 1 and the image quality can therefore be stabilized.

Modified Example 3

In Modified Examples 1 and 2 of FIG. 14 and FIG. 15, the first abutting portion 40 or 140, and the first positioning portion 37*c*, which is the second abutting portion, are integrated, but the present invention is not limited to such a configuration.

Figure 16:
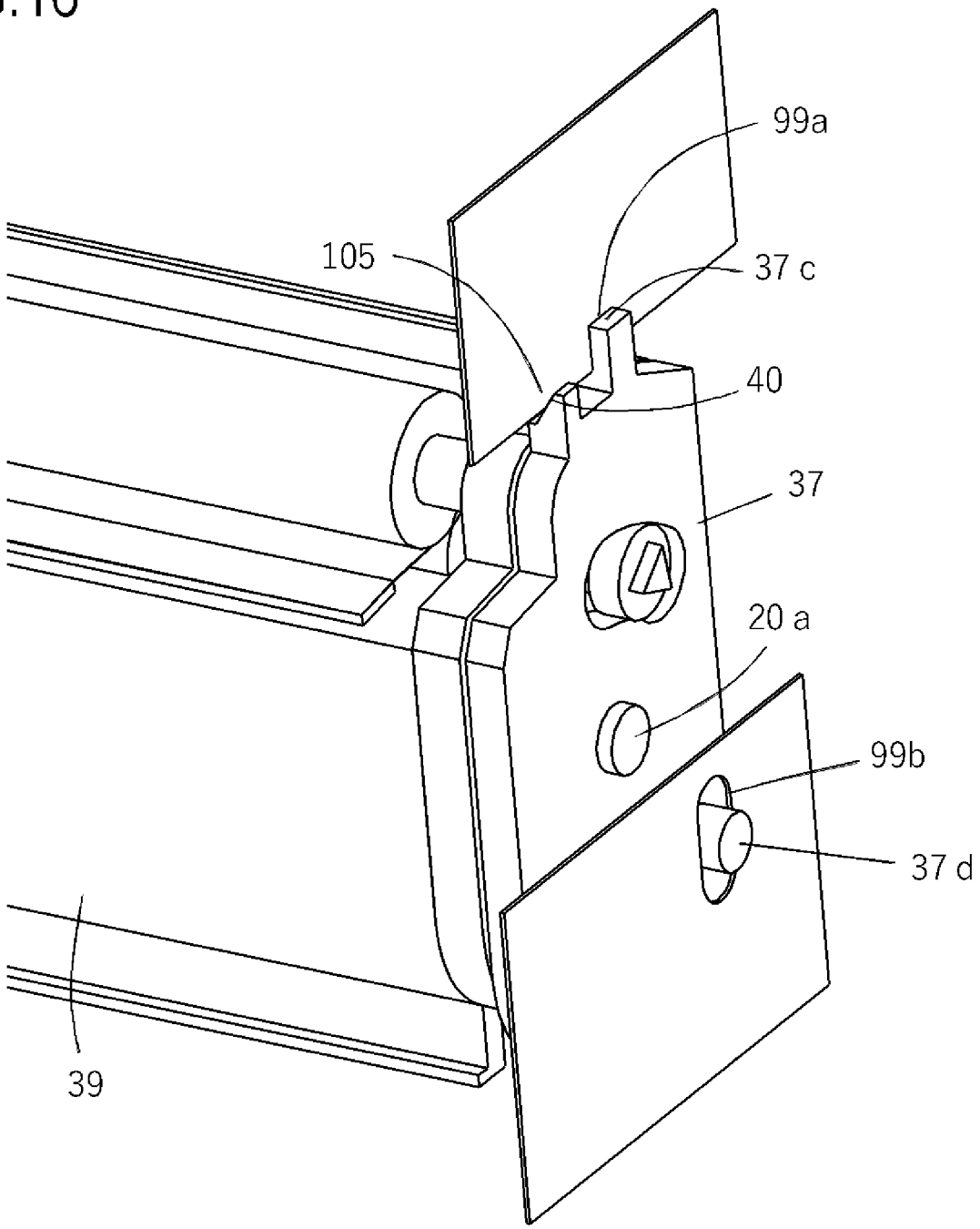
FIG. 16 is an explanatory view of a developing cartridge according to Modified Example 3.

As illustrated in FIG. 16, the first abutting portion 40 and the first positioning portion 37*c*, which is the second abutting portion, may be individually formed at separated positions. Also with such a configuration, the effect of preventing the rotation of the first end portion member 37 is obtained, and the image quality can be stabilized.

Others

The rotation regulating configuration for the end portion member described above may be applied to the second end portion member 38 in addition to the first end portion member 37. Further, in the present embodiment, the developing cartridge 4 is exemplified as a cartridge to which the above-mentioned rotation regulating configuration is applied. The present invention is, however, not limited thereto, and the rotation regulating configuration may be applied to other cartridges as appropriate.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-190415, filed on Sep. 29, 2017, which is hereby incorporated by reference herein in its entirety.

What is claimed is:

1. A developing apparatus, comprising:

a frame configured to rotatably support a developing roller;

a first end portion member provided at one end of the frame in an axial direction of the developing roller so as to be rotatable relative to the frame around a rotation axis parallel to the axial direction; and a second end portion member provided at another end of the frame in the axial direction so as to be rotatable relative to the frame around the rotation axis, wherein the first end portion member and the second end portion member can rotate independently of each other around the rotation axis, wherein the developing apparatus is removably mountable to an apparatus main body of an image forming apparatus in the axial direction, wherein at least one end portion member of the first end portion member and the second end portion member has a force receiving portion and a regulating portion, wherein the force receiving portion is provided on one side of the one end portion member in a first direction orthogonal to the rotation axis, and is able to receive a biasing force from a biasing member of the apparatus main body in a mounting direction when the developing apparatus is mounted to the apparatus main body, wherein the regulating portion is provided on the other side of the one end portion member in the first direction, and has a first abutting portion that is able to contact the apparatus main body to regulate movement of the other side of the one end portion member relative to the apparatus main body in a direction opposite to the mounting direction, with a fulcrum being the rotation axis, and when the developing apparatus is positioned relative to the apparatus main body, the first abutting portion is brought into abutment against the apparatus main body in the direction opposite to the mounting direction while the force receiving portion is abutted by the apparatus main body in the mounting direction.

2. The developing apparatus according to claim 1, wherein the regulating portion also regulates movement of the one end portion member relative to the apparatus main body in a direction orthogonal to the mounting direction.

3. The developing apparatus according to claim 1, wherein the regulating portion has an inclined surface that is inclined to each of the rotation axis and the first direction, and wherein the regulating portion regulates the movement of the other side of the one end portion member relative to the apparatus main body in the direction opposite to the mounting direction, when the inclined surface is brought into abutment against the apparatus main body.

4. The developing apparatus according to claim 1, wherein the regulating portion has a vertical surface extended in the first direction, and wherein the regulating portion regulates the movement of the other side of the one end portion member relative to the apparatus main body in the direction opposite to the mounting direction, when the vertical surface is brought into abutment against the apparatus main body.

5. The developing apparatus according to claim 1, wherein the developing apparatus further comprises a second abutting portion that is brought into abutment against the apparatus main body in a direction orthogonal to the mounting direction, and wherein the regulating portion is provided downstream of the second abutting portion in the mounting direction.

6. The developing apparatus according to claim 5, wherein the regulating portion is positioned at a position farther from the rotation axis than a position at which the second abutting portion is positioned.

7. The developing apparatus according to claim 1, wherein the force receiving portion is positioned in a lower part in a gravity direction with respect to the rotation axis, and wherein the regulating portion is positioned in an upper part in the gravity direction with respect to the rotation axis.

8. An image forming apparatus, comprising:

the developing apparatus according to claim 1; and an apparatus main body to which the developing apparatus is removably mounted.

9. The image forming apparatus according to claim 8, wherein the apparatus main body includes a biasing member and a positioning portion, wherein the biasing member applies a biasing force to the force receiving portion of the developing apparatus in the mounting direction, wherein the positioning portion is brought into contact with the one end portion member on a side opposite to the biasing member in the first direction, the side being defined with a boundary which is the rotation axis, and wherein the regulating portion of the developing apparatus is brought into contact with the positioning portion in the direction opposite to the mounting direction.

* * * * *